US009035792B2

(12) United States Patent
Hanisch

(10) Patent No.: US 9,035,792 B2
(45) Date of Patent: May 19, 2015

(54) METHOD FOR DETECTING VEHICLES WITH CARGO

(71) Applicant: KAPSCH TRAFFICCOM AG, Vienna (AT)

(72) Inventor: Harald Hanisch, Vienna (AT)

(73) Assignee: Kapsch TrafficCom AG, Vienna (AT)

( * ) Notice: Subject to any disclaimer, the term of this patent is extended or adjusted under 35 U.S.C. 154(b) by 274 days.

(21) Appl. No.: 13/855,952

(22) Filed: Apr. 3, 2013

(65) Prior Publication Data

US 2013/0293392 A1 Nov. 7, 2013

(30) Foreign Application Priority Data

May 3, 2012 (EP) ..... 12166498

(51) Int. Cl.
*G08C 19/22* (2006.01)
*G08C 17/02* (2006.01)
*G08G 1/017* (2006.01)

(52) U.S. Cl.
CPC ..... *G08C 17/02* (2013.01); *G08G 1/017* (2013.01)

(58) Field of Classification Search
None
See application file for complete search history.

(56) References Cited

U.S. PATENT DOCUMENTS 5,008,661 A * 4/1991 Raj ..... 340/10.51
5,347,274 A * 9/1994 Hassett ..... 340/988
5,774,876 A * 6/1998 Woolley et al. ..... 705/28
5,913,180 A * 6/1999 Ryan ..... 702/45
7,273,172 B2 * 9/2007 Olsen et al. ..... 235/385
8,115,608 B2 * 2/2012 Davis et al. ..... 340/425.5
2003/0233189 A1 * 12/2003 Hsiao et al. ..... 701/207
2004/0174260 A1 * 9/2004 Wagner ..... 340/568.1
2006/0261935 A1 * 11/2006 McAden ..... 340/431
2009/0146815 A1 * 6/2009 Cho ..... 340/572.1
2009/0160646 A1 * 6/2009 Mackenzie et al. ..... 340/572.1
2010/0223090 A1 * 9/2010 Lozito ..... 705/9
2010/0253483 A1 * 10/2010 Yang et al. ..... 340/10.4

FOREIGN PATENT DOCUMENTS

EP 2 372 667 A1 10/2011
EP 2 431 946 A1 3/2012

OTHER PUBLICATIONS

Extended European Search Report for corresponding European Patent Application No. 12166498.1, dated Jul. 18, 2012, 8pp.

* cited by examiner

*Primary Examiner* — Curtis King
(74) *Attorney, Agent, or Firm* — Fiala & Weaver P.L.L.C.

(57) ABSTRACT

A method for detecting vehicles with cargo in a traffic telematics system comprising at least one radio beacon for radio communication with onboard units (OBUs) carried by vehicles and their cargo. The method including: establishing radio communications between said radio beacon and a first OBU, and between said radio beacon and a second OBU, via radio signals; electronically evaluating said radio signals; and when said evaluation indicates that said first and second OBUs are moving at a limited and constant distance from one another, receiving characteristic data from the first OBU in the radio beacon, transmitting the characteristic data from the radio beacon to the second OBU, and recording the characteristic data in a memory of the second OBU.

16 Claims, 3 Drawing Sheets

METHOD FOR DETECTING VEHICLES WITH CARGO

CROSS-REFERENCE TO RELATED APPLICATION(S)

This application claims priority to and the benefit of European Patent Application No, 12166498.1, filed on May 3, 2012, the entire disclosures of which are incorporated herein by reference.

FIELD OF THE INVENTION

The present invention relates to a method for detecting vehicles with cargo in a traffic telematics system, in particular, to a road toll or road communication system, which comprises at least one radio beacon for the radio communication with onboard units (OBUs) carried by the vehicles and the cargo.

BACKGROUND

A method, in which the cargo is a trailer towed by the vehicle, is disclosed by EP 2 372 667 A1 by the same applicant, the entire contents of which are hereby expressly incorporated by reference. The present invention refines this method to create new fields of application.

SUMMARY

In some embodiments, the present invention is a method for detecting vehicles with cargo in a traffic telematics system including at least one radio beacon for radio communication with onboard units (OBUs) carried by vehicles and their cargo. The method includes: establishing radio communications between said radio beacon and a first OBU, and between said radio beacon and a second OBU, via radio signals; electronically evaluating said radio signals; and when said evaluation indicates that said first and second OBUs are moving at a limited and constant distance from one another, receiving characteristic data from the first OBU in the radio beacon, transmitting the characteristic data from the radio beacon to the second OBU, and recording the characteristic data in a memory of the second OBU.

In some embodiments, the OBU from which the characteristic data is read out (received) is associated with the cargo ("cargo OBU") and the other OBU to which the read-out characteristic data are written (in edited or unedited form) by the radio beacon is associated with the vehicle ("vehicle OBU"). This variant is suited for tolling purposes because the charging of the toll for the (tractive) vehicle is carried out dependent on a cargo that is declared by the cargo OBU, and the cargo history can be monitored and verified at any time based on the log in the memory of the vehicle OBU, In these embodiments, the characteristic data comprises an identifier of the cargo, for example, the hazardous goods classification, tonnage, shipping data such as origin and destination, or the like.

The method of the invention requires no special positioning of the cargo OBU inside the vehicle, trailer or combination comprising a vehicle and trailer(s). The cargo OBU can be mounted both in a trailer and in the cargo bay or in the driver's cab of a truck or prime mover. The two OBUs are preferably arranged next to each other in the vehicle, for example directly next to each other on the windshield.

The radio communication with the one OBU in the radio beacon is handled with priority over the radio communication with the other OBU. This allows the number of necessary radio communications, which is to say of data packets that are transmitted back and forth between the radio beacon and the OBUs via the radio interface, to be minimized.

The aforementioned evaluation of the radio communications for the purpose of measuring the distance between the two OBUs can be achieved in any manner known in the prior art. In some embodiments, the phase shift between the two radio communications is used to measure the distance between the OBUs, As an alternative or in addition, the amplitude difference and/or the Doppler shift of the two radio communications may be used to measure the movements of the OBUs. In some embodiments, only radio communications within a predetermined time window are taken into consideration so as to increase the evaluation reliability.

In some embodiments, the method of the invention is suited for road toll systems according to the dedicated short range communication (DSRC) standard, in all the different technological embodiments, for example infrared, microwave at 5.8 GHz or 5.9 GHz and the like. The radio beacons are thus DSRC radio beacons, and the OBUs are DSRC OBUs, that may be based on infrared or microwave.

The aforementioned evaluation of the radio communications can be carried out centrally in a central system or in a decentralized manner in a radio beacon or a local control unit of the road toll system that is, for example, provided for several radio beacons.

After a pair of OBUs that belong to each other is detected, toll accounts belonging to the OBUs can be associated with each other in the central system and/or the radio beacons. This allows both toll accounts, the one of the vehicle OBU and that of the cargo OBU, to be debited simultaneously. Alternatively, only the toll account of the vehicle OBU may be debited. In the latter case, it is possible to prevent that cargo OBUs are charged tolls as separate "vehicles" and to assure that the vehicle toll account is debited with a cargo toll.

BRIEF DESCRIPTION OF THE DRAWINGS

The invention will be described in more detail hereafter based on an exemplary embodiment, which is shown in the accompanying drawings. In the drawings.

DETAILED DESCRIPTION

Figure 1:
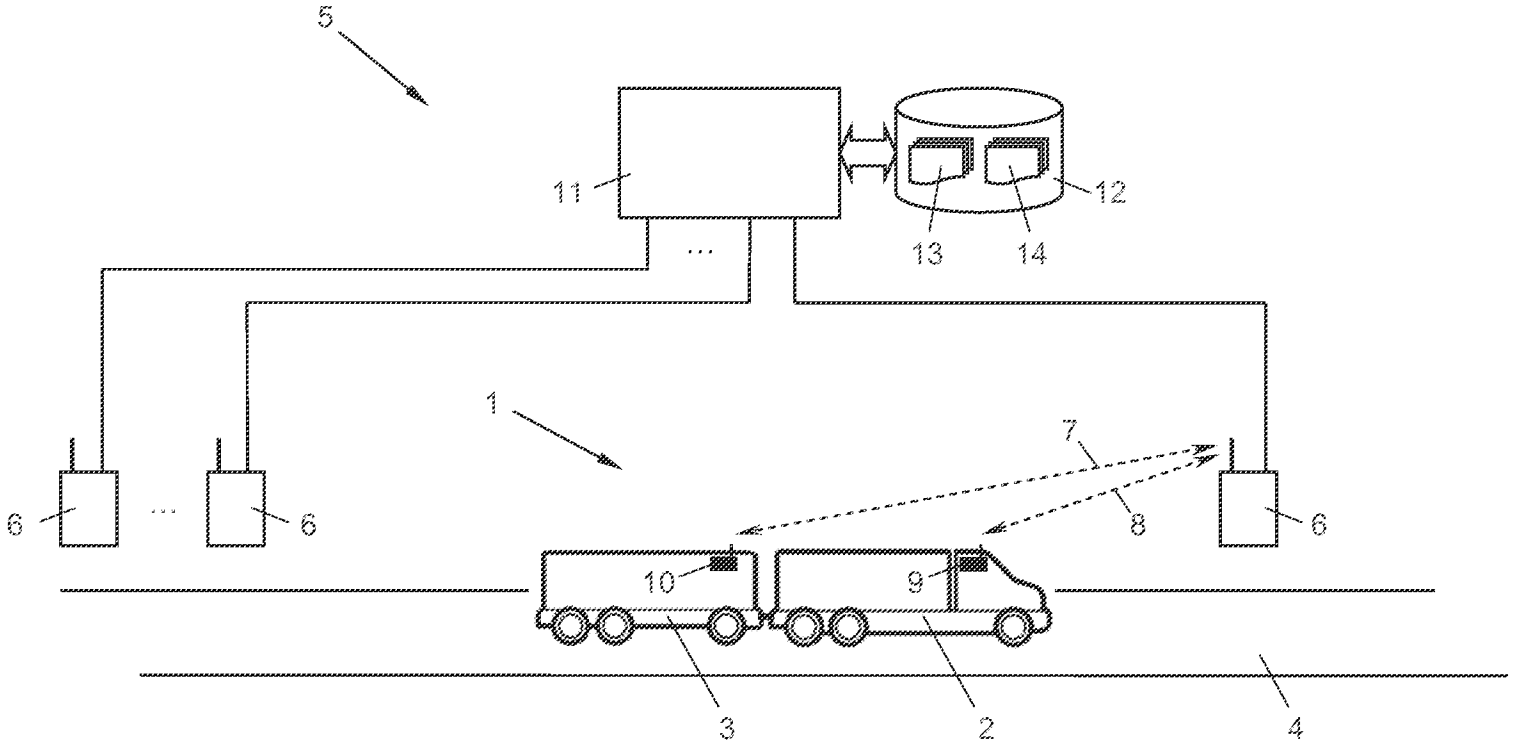
FIG. 1 shows a block diagram of some of the major components that are used within the scope of the method of the invention.

According to the present invention, a radio beacon receives characteristic data from an OBU and transmits the same, in edited or unedited form, to another OBU, which records the received characteristic data in a memory.

The invention thus allows cargo to be declared with the aid of a dedicated cargo OBU, which is associated with the vehicle OBU and can be charged a toll together therewith, resulting in a continued logging of the cargo carried by a particular vehicle or of the means of transportation used for a particular cargo. Every radio beacon that is passed by both OBUs reads characteristic data from one OBU and writes the same in unedited or edited form to another OBU, which is to say acts basically as a "copying or editing station" for characteristic data from one OBU to the other. Each time a radio beacon is passed, an additional characteristic data record is thus collected in the memory of an OBU. Over multiple beacon passages, a log, or a good picture, is thus obtained as to which cargo a vehicle is carrying or which vehicles transported a cargo.

The characteristic data of the associated OBUs that are recorded in the memory of an OBU and derived from the last beacon passages can be used for a wide variety of toll collection, enforcement or evidence purposes. For example, the log of cargoes of a vehicle can be included in the computation of the toll thereof, the history of the means of transportation can be included in the computation of the toll for a cargo load, or the compliance with hazardous material identifications, weekend driving bans and the like can be monitored and enforced. The documented characteristic data can therefore be read out via an interface of the OBU for control purposes, via radio communication. The characteristic data records of one or both OBUs can optionally be transmitted by a radio beacon to a back office of a traffic telematics system for tracking the cargo or imposing a toll.

In some embodiments, the radio beacon adds a time stamp and/or an identifier of the radio beacon to the characteristic data, so that the location and the time of the copying process of the characteristic data from one OBU to another can be recorded. The recorded characteristic data thus constitute a complete logbook in terms of the time at which two OBUs were associated with each other, and at which radio beacon, which is to say what cargo a vehicle was transporting or by which vehicles the cargo was transported.

The characteristic data that are read from the one OBU by the radio beacon and written—in edited or unedited form—to the other OBU can be of a variety of types, for example a user identifier or account identifier, a vehicle identifier, such as a chassis number or license plate number, a cargo identifier such as a shipping number, hazard goods declaration or cargo description, parameterized data such as vehicle class, cargo class, weight, hazard goods classification, restrictions in terms of time such as weekend driving permission or ban, and the like. In a simple case, the characteristic data comprise at least one identifier of the OBU from which the characteristic data is read.

The characteristic data can be transmitted by the radio beacon both from a vehicle OBU to a cargo OBU and vice versa, In some embodiments, the respective characteristic data of the other OBU are written to an OBU, so that both OBUs always include a complete log of the mutual association thereof.

As shown in FIG. 1, a tractor-trailer 1 comprising a vehicle 2 and cargo 3 (here in the form of a trailer) is traveling on a road 4 as part of a road toll system 5, which charges fees (tolls) for the usage of the road, The road toll system 5 comprises a plurality of roadside radio beacons 6, which can conduct short range radio communications 7, 8 with radio onboard units (OBUs) 9, 10 that are carried. by the tractor-trailer 1. The radio communications 7, 8 may take place according to a DSRC standard.

Because the locations of the radio beacons 6 are known and the ranges of the radio communications 7, 8 thereof are limited, the OBUs 9, 10 can be located in terms of the respective radio coverage ranges of the radio beacons 6 and thus tolls can be charge for usage of the road 4, The radio beacons 6 also have a data connection with a central system 11, which manages toll accounts (OBU accounts) 13, 14 for the OBUs 9, 10 in a database 12. However, the toll accounts can also be managed in a decentralized manner, for example in local computers at or in the radio beacons 6.

In some embodiments, which the invention also encompasses, the OBUs 9, 10 may be of the self-locating type, for example, by way of an integrated satellite navigation receiver, and transmit the positions thereof via the radio communications 7, 8 to the radio beacons 6. In this case, the radio communications 7, 8 need not have locally limited ranges and could, for example, be mobile communication connections, Moreover, the radio beacons 6 may be base stations of a mobile communication network, as is known from the prior art.

As shown in FIG. 1, dedicated OBUs 9, 10 are associated with the vehicle 2 and the cargo 3, respectively, The database 12 of the central system 11 or of the remote computer includes dedicated vehicle accounts 13 for vehicle OBUs 9 and dedicated cargo accounts 14 for cargo OBUs 10.

The cargo OBUs 10 can be mounted in or on the cargo 3 itself, and in the vehicle 2, for example, directly next to the vehicle OBU 9 on the windshield of the driver's cab of the vehicle 2.

The cargo 3 may be transported not only in the form of a separate trailer, but also in any other form on the tractor-trailer 1, for example, as units on pallets, by the trailer or directly by the vehicle 2. For example, the vehicle 2 may transport in the cargo bay thereof several cargo loads 3 comprising several cargo OBUs 10. Everything that is described here with respect to the association of a vehicle OBU 9 with a single cargo OBU 10 also similarly applies to the association of a vehicle OBU 9 with multiple cargo OBUs 10 for multiple cargo loads 3 transported by the vehicle 2.

Because the two OBUs 9, 10 move on the tractor-trailer 1 at a small and constant distance from each other, this circumstance can be determined by evaluating the physical parameters of the radio communications 7, 8. For example, the phase shift between the radio communications 7, 8 can be used to measure the distance between the OBUs 9, 10. If this distance is smaller than a predetermined maximum distance and does not change significantly over a monitoring period in the coverage range of a radio beacon 6, a pair of vehicle OBU 9 and cargo OBU 10 that belong to each other can be determined. As an alternative or in addition, the Doppler shift in the radio communications 7, 8 may be measured and, based thereon, the movements of the OBUs 9, 10 may be determined. If these take place in the same direction and at the same speed, the pair of OBUs 9, 10 that belong to each other can be determined.

Figure 2:
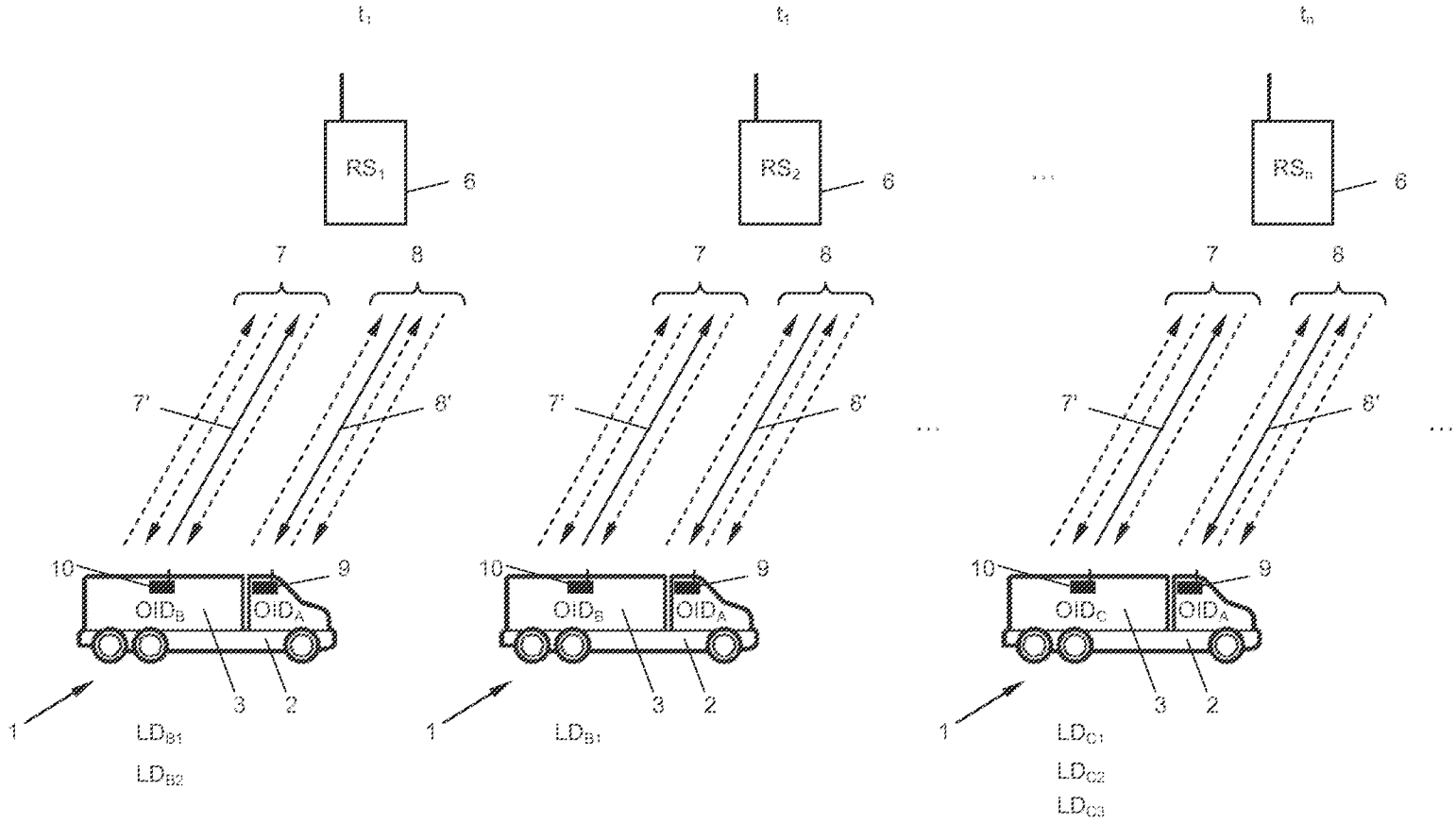
FIG. 2 is a schematic illustration of radio communications between OBUs and radio beacons during consecutive beacon passages, according to some embodiments of the present invention.
Figure 3:
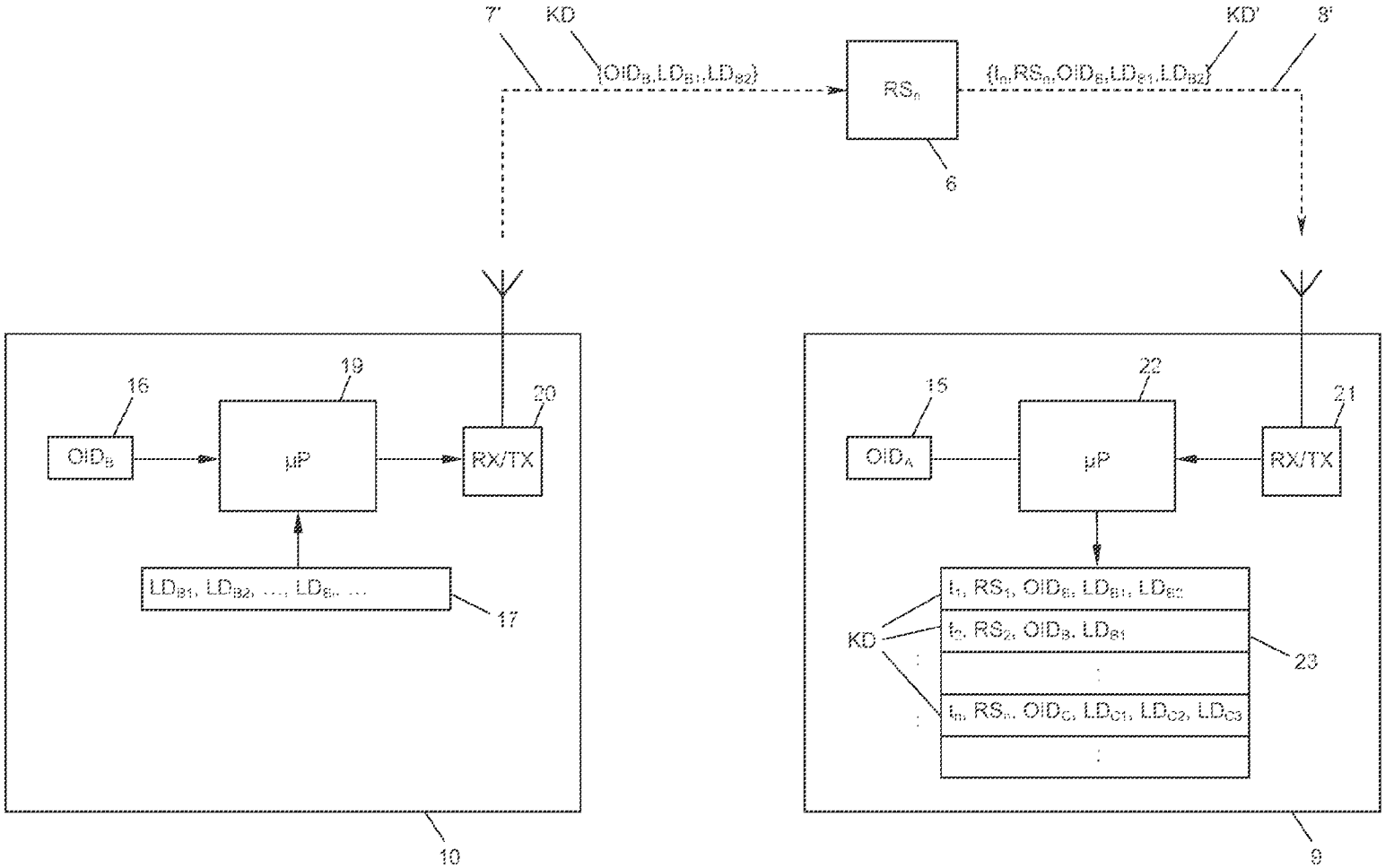
FIG. 3 shows a block diagram of a vehicle OBU and of a cargo OBU in connection with a radio beacon, according to some embodiments of the present invention.

As an alternative or in addition, the physical proximity of two OBUs 9, 10 can be determined solely from the temporal coincidence of radio communications 7, 8. For example, if the vehicles on the road 4 are accordingly separated or the radio communications 7, 8 are handled in a very short time (as a "burst"), the passage of two closely adjacent OBUs 9, 10 may be inferred from two burst communications 7, 8 that follow each other in quick succession, After detecting a pair of OBUs 9, 10 that belong to each other, the related vehicle and cargo accounts 13, 14 may be associated with each other in the central system 11 or the remote computers of the beacons 6. This way, for example, both accounts 13, 14 may be debited simultaneously or—particularly preferably—only the vehicle account 13 could be debited, whereby this can prevent that cargo OBUs 10 are charged tolls as separate "vehicles" and also assure that the vehicle account 13 is debited with a cargo toll, FIGS. 2 and 3 show variations of the method of FIG, 1 for simultaneously recording the associations, as detected during the beacon passages, of jointly moving vehicle OBUs 9 and cargo OBUs 10. As shown in FIG. 2, the tractor-trailer 1, which is a vehicle 2 together with cargo 3 carried onboard, passes several successive beacons 6 having the beacon identifiers $RS_1$, $RS_2$, . . . , or $RS_n$ in general, at consecutive times $t_1$, $t_2$, or $t_n$ in general. Every time a beacon is passed, radio communications 7, 8 take place between the vehicle and cargo OBUs 9, 10 and the radio beacons 6. The radio communications 7, 8 in each case include individual radio communications (data packets) that are transmitted back and forth between the OBUs 9, 10 and the radio beacons 6, as is known to a person skilled in the art.

In the example shown, the vehicle OBUs 9 are equipped with unique OBU identifiers $OID_A$, which are stored in a memory 15 (FIG. 3) of the vehicle OBUs 9, for example. Similarly, the cargo OBUs 10 are each equipped with a unique OBU identifier $OID_B$ or $OID_c$, which is stored in a memory 16 of the cargo OBU 10. Moreover, the cargo OBUs 10 (optionally) comprise cargo declarations $LD_{B1}$, $LD_{B2}$,or $LD_{Bi}$ in general (in the case of the cargo OBU 10 having the identifier $OID_B$) or $LD_{C1}$, $LD_{C2}$, or $LD_{Ci}$ in general (in the case of the cargo OBU 10 having the identifier $OID_C$). The cargo declarations $LD_{Bi}$ or $LD_{Ci}$ are each stored in a memory 17 of the cargo OBU 10.

The cargo declarations $LD_{Bi}$, $LD_{Ci}$ may contain additional information about the content, properties, weight, volume, hazard category, weekend driving authorization, countries of origin and destination or the like, of the respective cargo 3, as described above.

In the example shown in FIG. 2, during passage of the first radio beacon 6 or $RS_1$, the tractor-trailer 1 carries a cargo 3 having the identifier $OID_B$ and two cargo declarations $LD_{B1}$ and $LD_{B2}$. During passage of the second radio beacon $RS_2$, a portion of the cargo 3, and accordingly also the cargo declaration $LD_{B2}$, had been removed, which is to say the cargo OBU 10 here only contains the cargo declaration $LD_{B1}$ in addition to the OBU identifier $OID_B$. Similarly, during passage of a later radio beacon $RS_n$, the entire cargo 3 had been replaced, and the tractor trailer 1 is composed of a vehicle comprising the vehicle OBU 9 having the OBU identifier $OID_A$ and new cargo 3 comprising the new cargo OBU 10 having the identifier $OID_C$ with three new cargo declarations $LD_{C1}$, $LD_{C2}$, $LD_{C3}$.

With every such passage of the beacons, in a first step characteristic data KD are read from the cargo OBU 10 and into the radio beacon 6 as part of the radio communications 7 between the radio beacon 6 and the cargo OBU 10 (see the specially highlighted radio communication 7 in FIGS. 2 and 3). The characteristic data KD can be the OBU identifier $OID_B$ of the cargo OBU 10 and/or one or several of the cargo declarations $LD_{Bi}$, $LD_{Ci}$, In the example shown, the characteristic data KD comprises all these data available in the memories 16 and 17 of the cargo OBU 10. Also, the cargo OBU 10 contains, in the known manner, a central processor 19 and a transceiver 20, with the aid of which, the cargo OBU transmits the characteristic data KD from the memories 16, 17 automatically or upon request from a radio beacon 6, to the radio beacon 6 as part of the radio communication 7.

The radio beacon 6 thereupon transmits the received characteristic data KD as part of one of the radio communications 8 with the vehicle OBU 9 that was recognized as belonging to the cargo OBU 10 (see the radio communication 8' shown by way of example). The radio beacon 6 can forward the characteristic data KD in unmodified form to the vehicle OBU 9 or in edited form, for example, in a processed and/or supplemented form. In the example shown, the radio beacon 6 supplements the characteristic data KD with a current time stamp $t_n$ and its own radio beacon identifier $RS_n$ to obtain edited characteristic data KD'. The vehicle OBU 9 receives the characteristic data KD, KD' forwarded from the radio beacon 6 by transceiver 21 and processor 22, and writes the same to a memory 23.

Every time a radio beacon 6 is passed, a new characteristic data record KD or KD' is written to the memory 23. The memory 23 thus contains a complete log of the respective associations that were detected during the radio beacon passages between a first OBU 9 (the vehicle OBU) and a second OBU 10 (the cargo OBU), which were part of a common tractor-trailer 1.

The operating principles of the cargo OBU 10 and vehicle OBU 9 in FIGS. 2 and 3 may be interchanged. That is, the radio beacon 6 can read out the characteristic data KD from a vehicle OBU 9 and write to a cargo OBU 10, so that a cargo OBU 10 can prepare a log of the means by which it was transported. In some embodiments, both characteristic data may be transmitted from the one OBU 9 to the other OBU 10 and from the other OBU 10 to the one OBU 9 (in edited or unedited form) so that both OBUs 9, 10 fill a respective memory 23 with a log of pass associations.

The content of the memory 23 can thereafter be read from the respective OBU 9, 10 for control, enforcement or evidence purposes, for example, via a wired interface or the transceiver 20, 21. For this purpose, for example, a portable read device can be used, which establishes a radio communication 7, 8 with the OBU 9, 10 and reads out the content of the memory.

Optionally, with each beacon passage, the determined association between two OBUs 9, 10 can be recorded in the radio beacon 6 and/or the central system 11 in conjunction with the read-out characteristic data KD. For example, the content of the memory 23 can be "mirrored" in the database 12 for further enforcement and evidence purposes, and in each case supplemented with the identifier $OID_A$ of the OBU in which the memory 23 is located.

If desired, the radio beacon 6 can prioritize the radio communications 7 or 7' with the OBU from which the characteristic data record KD is supposed to be read, over the radio communications 8 or 8', by way of which the characteristic data record KD, KD' is written to another OBU, For this purpose, all prioritization methods that are known in the prior an for radio communications between a radio beacon and several OBUs passing the same may be employed. For example, the methods described in EP 2 431 946 A1 by the same applicant are particularly suited, the entire contents of which are being hereby expressly incorporated by reference.

It is thus possible, for example based on properties, identifiers, speeds, locations and the like of the OBUs 9, 10, to identify the respective OBU 10 to be read out first and to prioritize, in terms of time, the radio communications 7 with respect to the radio communications 8. It can also be assured that the characteristic data KD from a previously determined radio communication 7 are already available during the radio communication 8, because of a higher priority.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

The invention claimed is:

1. A method performed by one or more processors for detecting vehicles with cargo in a traffic telematics system including a radio beacon for radio communication with onboard units (OBUs) carried by vehicles and their cargo, the method comprising:

establishing radio communications between said radio beacon and a first OBU, and between said radio beacon and a second OBU, via radio signals;

electronically evaluating said radio signals; and when said evaluation indicates that said first and second OBUs are moving at a limited and constant distance from one another, receiving characteristic data from the first OBU in the radio beacon, transmitting the characteristic data from the radio beacon to the second OBU, and recording the characteristic data in a memory of the second OBU.

2. The method according to claim 1, further comprising receiving the recorded characteristic data, via a radio communication.

3. The method according to claim 1, further comprising adding a time stamp and/or an identifier of the radio beacon to the characteristic, data before transmitting the characteristic data to the second OBU.

4. The method according to claim 1, wherein the characteristic data comprises an identifier of the first OBU.

5. The method according to claim 1, wherein the first OBU is associated with the cargo of the vehicle and the second OBU is associated with the vehicle.

6. The method according to claim 5, wherein the characteristic data comprises an identifier of the cargo.

7. The method according to claim 1, wherein the first and second OBUs are arranged next to each other in the vehicle.

8. The method according to claim 1, wherein the radio communication with the first OBU is handled in the radio beacon with priority over the radio communication with the second OBU.

9. The method according to claim 1, wherein said evaluation comprises using a phase shift between the two radio signals to measure the distance between the first and second OBUs.

10. The method according to claim 1, wherein said evaluation comprises using an amplitude difference between the two radio signals to measure the distance between the first and second OBUs.

11. The method according to claim 1, wherein said evaluation comprises using Doppler shifts of the two radio signals to measure the movements of the first and second OBUs.

12. The method according to claim 1, wherein said detecting comprises using only radio communications within a predetermined time window.

13. The method according to claim 1, wherein the radio beacon is a dedicated short range communication (DSRC) radio beacon and the first and second OBUs are DSRC OBUs.

14. The method according to claim 1, wherein the cargo is pulled by the vehicle in form of a trailer.

15. The method according to claim 1, wherein the cargo is transported on the vehicle or a trailer thereof.

16. The method according to claim 1, further comprising receiving the recorded characteristic data from the second OBU for control purposes via an interface of the second OBU.

* * * * *